United States Patent [19]

Narasimhan

[11] 4,268,564

[45] May 19, 1981

[54] STRIPS OF METALLIC GLASSES CONTAINING EMBEDDED PARTICULATE MATTER

[75] Inventor: Mandayam C. Narasimhan, Flanders, N.J.

[73] Assignee: Allied Chemical Corporation, Morris Township, Morris County, N.J.

[21] Appl. No.: 863,114

[22] Filed: Dec. 22, 1977

[51] Int. Cl.[3] ..... B32B 15/16; B32B 5/16

[52] U.S. Cl. ..... 428/143; 75/0.5 R; 164/97; 428/323; 428/329; 428/331; 428/332; 428/469; 428/472

[58] Field of Search ..... 428/323, 330, 328, 546, 428/558, 614, 143, 469, 412; 427/204, 205, 357, 374 C, 374 E, 328; 156/298; 29/400 R, 400 RL; 164/11, 47, 97; 75/122, 0.5 R; 148/2, 3, 4

[56] References Cited

U.S. PATENT DOCUMENTS

| | | | |
|---|---|---|---|
| 2,964,419 | 12/1960 | Link et al. | 427/204 |
| 3,084,064 | 4/1963 | Cowden et al. | 427/205 |
| 3,427,154 | 2/1969 | Mader et al. | 75/135 |
| 3,862,658 | 1/1975 | Bedell | 164/423 |
| 3,863,700 | 2/1975 | Bedell et al. | 164/423 |
| 3,881,541 | 5/1975 | Bedell | 164/423 |
| 3,881,542 | 5/1975 | Polk et al. | 164/423 |
| 3,939,900 | 2/1976 | Polk et al. | 164/423 |
| 3,964,535 | 6/1976 | Bedell et al. | 164/423 |
| 4,077,462 | 3/1978 | Bedell et al. | 164/429 |
| 4,142,571 | 3/1979 | Narasimhan | 164/437 |

OTHER PUBLICATIONS

"Metallic Glasses", *Physics Today,* May 1975, vol. 28, No. 5.

*Primary Examiner*—Paul J. Thibodeau
*Attorney, Agent, or Firm*—Gerhard H. Fuchs

[57] ABSTRACT

Strips of amorphous metal containing embedded particulate matter and method for making it. Strips of amorphous metal containing embedded particles of abrasive material are useful for working the surfaces of solid articles by abrasion for forming or surface improvement. The method of making such strips involves forcing molten metal of a glass-forming alloy containing admixed particulate matter onto the surface of a moving chill body under pressure through a slotted nozzle located in close proximity to the surface of the chill body.

5 Claims, 4 Drawing Figures

STRIPS OF METALLIC GLASSES CONTAINING EMBEDDED PARTICULATE MATTER

BACKGROUND OF THE INVENTION

This invention relates to continuous metal strips, particularly metal strips with an amorphous molecular structure, containing embedded particulate matter. These strips are made by depositing molten metal containing admixed particulate matter onto the rapidly moving surface of a chill body by forcing the metal through a slotted nozzle located in close proximity to the surface of the chill body.

For purposes of the present invention, a strip is a slender body whose transverse dimensions are much less than its length, including wire, ribbons and sheets, of regular or irregular cross section.

In my copending U.S. Appl. Ser. No. 821,110 filed Aug. 2, 1977, and now U.S. Pat. No. 4,142,571 there is disclosed a method and apparatus for casting continuous metal strips by forcing molten metal onto the surface of a moving chill body under pressure through a slotted nozzle located in close proximity to the surface of the chill body. Critical selection of nozzle dimensions, velocity of movement of the chill body surface, and gap between nozzle and chill body surface permits production of continuous polycrystalline metal strip at high speeds, and of amorphous metal strips having high isotropic strength, theretofore unobtainable dimensions, and other isotropic physical properties, such as magnetizability.

SUMMARY OF THE INVENTION

I have now made the surprising discovery that in the process disclosed in my above-referred to copending application finely divided particulate matter of the type that is substantially inert, that is to say substantially chemically non-reactive, with respect to the base metal under processing conditions encountered in that process, amorphous metal strip can be cast containing substantially uniformly incorporated particulate matter. This is surprising because it has heretofore been believed that incorporation of particulate matter, especially of wettable particulate matter into a molten glass-forming alloy would preclude its being quenched into an amorphous (glassy) solid body because the particulate matter would inevitably cause nucleation of the crystallization process. Apparently, my casting process provides such high quench rate that nucleation of crystallization can be avoided, so that it permits incorporation of particulate matter into a metallic glass matrix. Also, it has been found that in the melt spin process employing a pressurized orifice which permits manufacture of metal strip directly from the melt [see, e.g., Zeitschrift fuer Metallkunde 64, 835–843 (1973)], inclusion of particulate matter in the metal melt leads to rapid plugging of the jetting orifice, causing shutdown of the process.

Furthermore, I have surprisingly discovered that if in my casting process particulate matter is dispersed in the molten metal to be cast, that particulate matter in the casting operation tends to rise to the top surface of the strip being cast, such that it protrudes from that surface of the strip yet is firmly anchored within the metal matrix. No particulate matter is seen on the quenched surface of the strip.

The invention provides a method for forming a continuous metal strip containing embedded particulate matter on one side of the ribbon only by depositing molten metal containing dispersed particulate matter onto the surface of a moving chill body, which involves moving the surface of a chill body in a longitudinal direction at a constant, predetermined velocity within the range of from about 100 to 2000 meters per minute past the orifice of a slotted nozzle defined by a pair of generally parallel lips located proximate to said surface such that the gap between the lips and the surface is from between about 0.03 to about 1 millimeter, and forcing a stream of the molten metal containing the dispersed particulate matter through the orifice of the nozzle into contact with the surface of the moving chill body to permit the metal to solidify thereon to form a continuous metal strip containing embedded particulate matter. The orifice of the slotted nozzle is being arranged generally perpendicular to the direction of movement of the surface of the chill body. Desirably, the molten metal is an alloy which, upon cooling from the melt and quenching at a rate of at least about $10^{4°}$ C./sec. forms an amorphous solid; it may also form a polycrystalline metal. The particulate will usually be arranged at or near the top surface of the strip.

The particulate matter to be incorporated into the metal strip must be substantially inert, that is to say substantially non-reactive with respect to the metal under the processing conditions encountered in my process, and it must be dispersible in the melt. A reasonably close density match between the particles and the melt will aid dispersibility. The particles may be an equilibrium intermetallic phase. The particles may be wetting or non-wetting with respect to the molten metal, so long as they are substantially inert. The particles, of course, must have a melting point lying above the casting temperature of the metal. The amount of particulate matter to be incorporated into the strip is not critical, the essential limitation being imposed by the requirement that the dispersion of the particulate matter in the molten metal has sufficient fluidity to permit casting into strip by my method. Usually, this requirement is met if the amount of particulate matter dispersed in the metal melt does not exceed about 30 percent by volume, more usually about 10 percent by volume, of the combined volume of the metal and the particulate matter. There is no lower limit on the amount of particulate matter which may be so incorporated. There is also no lower limit on the particle size of the particulate matter. The upper particle size limit, of course, is set by the gap between the lip of the casting nozzle and the chill surface.

The apparatus required for making the metalic strips containing embedded particulate matter broadly comprises a movable chill body, a slotted nozzle in communication with a reservoir for holding the molten metal containing dispersed particulate matter, and means for effecting expulsion of that molten metal from the reservoir through the nozzle onto the moving chill surface.

The movable chill body provides a chill surface for deposition thereon of the molten metal for solidification. The chill body is adapted to provide longitudinal movement of the chill surface at velocities in the range of from about 100 to about 2000 meters per minute.

The reservoir for holding the molten metal includes heating means for maintaining the temperature of the metal above its melting point and, optionally, agitator means for holding the dispersed particulate matter in dispersion. The reservoir is in communication with the slotted nozzle for depositing the molten metal onto the chill surface.

The slotted nozzle is located in close proximity to the chill surface. Its slot is arranged perpendicular to the direction of movement of the chill surface. The slot is defined by a pair of generally parallel lips, a first lip and a second lip, numbered in direction of movement of the chill surface. The slot must have a width, measured in direction of movement of the chill surface, of from about 0.3 to about 1 millimeter. There is no limitation on the length of the slot (measured perpendicular to the direction of movement of the chill surface) other than the practical consideration that the slot should not be longer than the width of the chill surface. The length of the slot determines the width of the strip or sheet being cast.

The width of the lips, measured in direction of movement of the chill surface, is a critical parameter. The first lip has a width at least equal to the width of the slot. The second lip has a width of from about 1.5 to about 3 times the width of the slot. The gap between the lips and the chill surface is at least about 0.1 times the width of the slot, but may be large enough to equal to width of the slot.

Means for effecting expulsion of the molten metal containing the dispersed particulate matter from the reservoir through the nozzle for deposition onto the moving chill surface include pressurization of the reservoir, such as by an inert gas, or utilization of the hydrostatic head of the molten metal if the level of metal in the reservoir is located in sufficiently elevated position.

The present invention further provides a novel metallic strip containing particulate matter embedded therein such that it protrudes from one of the surfaces of the strip only and is finely anchored within the metal matrix provided by the metal strip. In a particularly desirable embodiment, such metallic strip is comprised of a metal having an amorphous structure. Such metallic strip is eminently suitable for use as an abrasive material, because the particulate matter is more firmly bonded within the metal matrix than in conventional composite abrasives employing ceramic or adhesive bonding agents. Moreover, the bonding matrix is thermally conductive, providing for improved dissipation of heat generated in abrading operations.

BRIEF DESCRIPTION OF THE DRAWINGS

In FIG. 2, formation of strip containing embedded particulate matter takes place on the surface of a chill roll mounted to rotate around its longitudinal axis. In FIG. 3, formation of such strip takes place on the surface of an endless moving belt.

DETAILED DESCRIPTION OF THE INVENTION AND THE PREFERRED EMBODIMENTS

Figure 1:
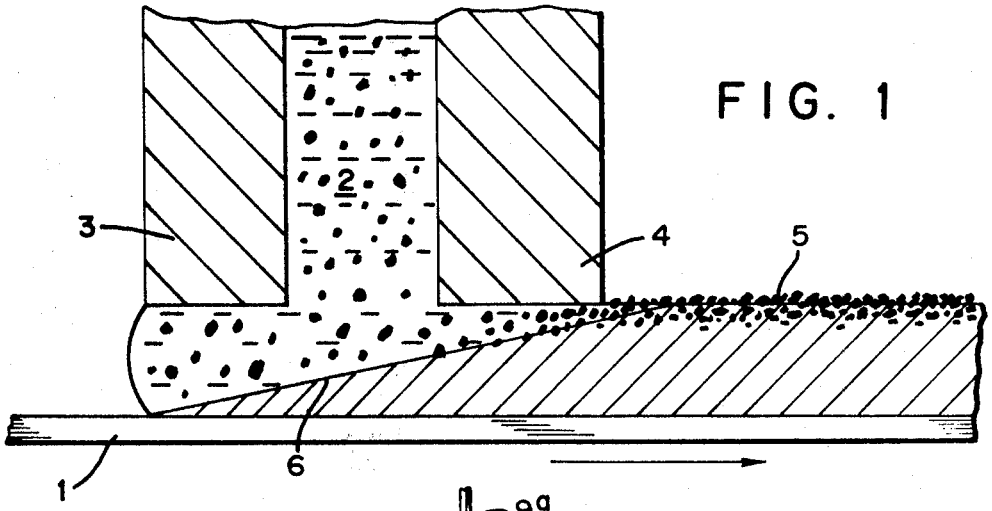
FIG. 1 of the drawings provides a side view in partial cross section schematically illustrating formation of strip containing embedded particulate matter from molten metal containing dispersed particulate matter deposited onto a moving chill surface from a nozzle having specific configuration and placement with relation to the chill surface, in accordance with the present invention.

FIG. 1 shows in partial cross section a side view illustrating the method of the present invention. As shown in FIG. 1, a chill body 1, here illustrated as a belt, travels in the direction of the arrow in close proximity to a slotted nozzle defined by a first lip 3 and a second lip 4. Molten metal 2 containing dispersed particulate matter is forced under pressure through the nozzle to be brought into contact with the moving surface of the chill body. As the metal is solidified in contact with the surface of the moving chill body, a solidification front, indicated by line 6, is formed. Above the solidification front a body of molten metal is maintained. The rising solidification front tends to push the dispersed particulate matter into the body of molten metal thereabove, so that ultimately the particulate matter rises to the surface of the metal strip to protrude therefrom, while remaining firmly embedded in the metal matrix.

The solidification front barely misses the end of second lip 4. First lip 3 supports the molten metal essentially by the pumping action of the melt which results from constant removal of solidified strip 5. The surface of the moving chill body 1 travels at a velocity within the range of from about 100 to about 2000 meters per minute. The rate of flow of molten metal equals the rate of removal of metal in the form of solid strip and is self-controlled. The rate of flow is pressure assisted, but controlled by the forming solidification front and the second lip 4 which mechanically supports the molten metal below it. Thus, the rate of flow of the molten metal containing the dispersed particulate matter is primarily controlled by the viscous flow between the second lip and the solid strip being formed, and is not primarily controlled by the slot width. The support provided by the viscous flow can easily accomodate the particulate matter. In order to obtain a sufficiently high quench rate to make an amorphous metal strip containing embedded particulate matter, the surface of the chill body must ordinarily move at a velocity of at least about 200 meters per minute. At lower velocities it is generally not possible to obtain quench rates, that is to say cooling rates at the solidification temperature, of at least $10^{4}$° C. per second, as is required in order to obtain amorphous metal strips. Lower velocities, as low as about 100 meters per minute, are usually operable, but result in polycrystalline strips. And, in any event, casting by this process of metal alloys which do not form amorphous solids will result in polycrystalline strips containing embedded particulate matter, regardless of the velocity of movement of the chill surface. The velocity of movement of the chill surface should not be in excess of about 2000 meters per minute because as the speed of the chill surface increases, the height of the solidification front is depressed due to decreased time available for solidification. This leads to formation of thin, uneven strip (thickness less than about 0.02 millimeter). As a general proposition, it can be stated that an increase in chill surface velocity results in production of thinner strip and, conversely, that a reduction of that velocity results in thicker strip. Preferably, chill surface velocities range from about 300 to about 1500, more preferably from about 600 to about 1000 meters per minute.

Figure 4:
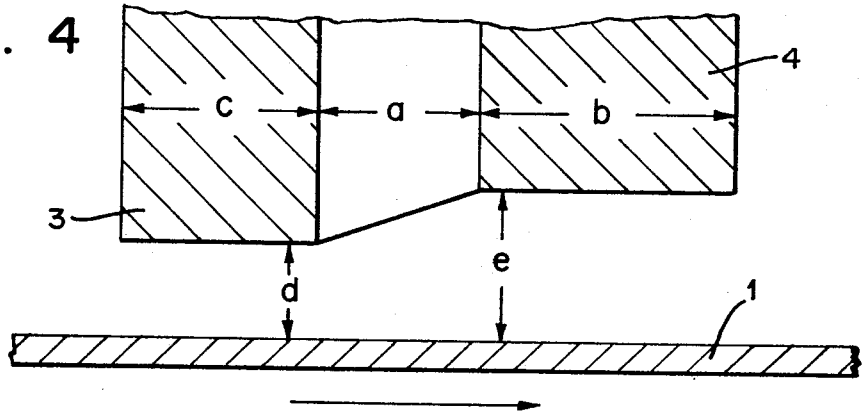
FIG. 4 provides a side view in cross section of a nozzle in its relation to the surface of the chill body for discussion of required relative dimensions of slot width, lip dimensions, and gap between lip and chill surface.

In order to obtain solid continuous strip of uniform cross section containing embedded particulate matter, certain dimensions concerning the nozzle and its interrelationship with the chill surface are critical. They are explained with reference to FIG. 4 of the drawings. With reference to FIG. 4, width a of the slot of the slotted nozzle, which slot is arranged perpendicular to the direction of movement of the chill surface, should be from about 0.3 to about 1 millimeter, preferably from about 0.6 to about 0.9 millimeter. As previously stated, the width of the slot does not control the rate of flow of molten metal therethrough, but it might become a limiting factor if it were too narrow. While, to some extent, that may be compensated for by employing higher pressures to force the molten metal at the required rate through the narrower slot, it is more convenient to provide a slot of sufficient width. If, on the other hand, the slot is too wide, say wider than about 1 millimeter, than at any given velocity of movement of the chill surface, the solidification front formed by the metal as it solidifies on the chill surface will be correspondingly thicker, resulting in a thicker strip which could not be cooled at a rate sufficient to obtain amorphous strip, if this were desired.

With further reference to FIG. 4, width b of second lip 4 is about 1.5 to about 3 times the width of the slot, preferably from about 2 to about 2.5 times the width of the slot. Optimum width can be determined by simple routine experimentation. If the second lip is too narrow, then it will fail to provide adequate support to the molten metal and only discontinuous strip is produced. If, on the other hand, the second lip is too wide, solid-to-solid rubbing between the lip and the particulate matter protruding from the surface of the strip will result, leading to rapid failure of the nozzle. With further reference to FIG. 4, width c of first lip 3 must be at least about equal to the width of the slot, preferably at least about 1.5 times the width of the slot. If the first lip is too narrow, then the molten metal will tend to ooze out, the molten metal will not uniformly wet the chill surface, and no strip, or only irregular strip will be formed. Preferred dimensions of the first lip are from about 1 to about 3, more preferably from about 1.5 to about 2.5 times the width of the slot.

Still with reference to FIG. 4, the gap between the surface of the chill body 1 and first and second lips 3 and 4, respectively represented by d and e, may be from about 0.03 to about 1 millimeter, preferably from about 0.03 to about 0.25 millimeter, more preferably yet from about 0.03 to about 0.15 millimeter. A gap in excess of about 1 millimeter would cause flow of the molten metal to be limited by slot width rather than by the lips. Strips produced under this condition are thicker, but are of non-uniform thickness, and the particulate matter tends to lack uniformity of distribution near or at the top surface of the strip. Moreover, such strips usually are insufficiently quenched and consequently have non-uniform properties, and tend to be brittle. Such product lacks commercial acceptability. On the other hand, a gap of less than about 0.03 millimeter would tend to lead to solid-to-solid contact between the particulate matter brought toward the surface by the solidification front and the nozzle when the slot width is in excess of about 0.3 millimeter, leading to rapid failure of the nozzle. Within the above parameters, the gap between the surface of the chill body and the lips may vary.

When the chill surface is a flat surface, such as a belt, the gaps between the surface of the chill surface and the first and second lips represented by dimensions d and e in FIG. 4 may be equal. If however, the movable chill body furnishing the chill surface is an annular chill roll then these gaps may not be equal, or else the strip formed will not easily separate from the chill roll, but it will tend to be carried around the perimeter of the roll and can hit and destroy the nozzle. This can be avoided by making gap d smaller than gap e, that is to say, by providing a smaller gap between the first lip and the chill surface than between the second lip and the chill surface. Also, the larger the difference in the size of the gap between the first and the second lip and the chill surface, the closer to the nozzle the strip will separate from the chill surface so that, by controlling the difference between these gaps, the point of separation of the strip from the annular chill roll can be controlled. Such difference in gaps can be established by slightly tilting the nozzle so that its exit points in direction of rotation of the chill roll, or by off-center mounting of the nozzle. If desired, of course, the strip can be separated from the chill roll by means of a mechanical stripper at any desired point.

Within the above parameters, when, for example, the chill surface may be moved at a velocity of about 700 meters per minute, the width of the slot may be between about 0.5 to 0.8 millimeter. The second lip should be between 1.5 to 2 times the width of the slot, and the first lip should be about 1 to 1.5 times the width of the slot. The metal in the reservoir should be pressurized to between about 0.5 to 2 psig. The gap between the second lip and the substrate may be between about 0.05 to 0.2 millimeter. If an annular chill roll is employed, the gap between the first lip and the surface of the chill body must be less than the gap between the second lip and the surface of the chill body, as above discussed. This can, for example, be accomplished by off-center mounting of the nozzle. Increasing the gap and/or the gas pressure increases the strip thickness when the velocity of movement of the chill surface remains unchanged.

Figure 2:
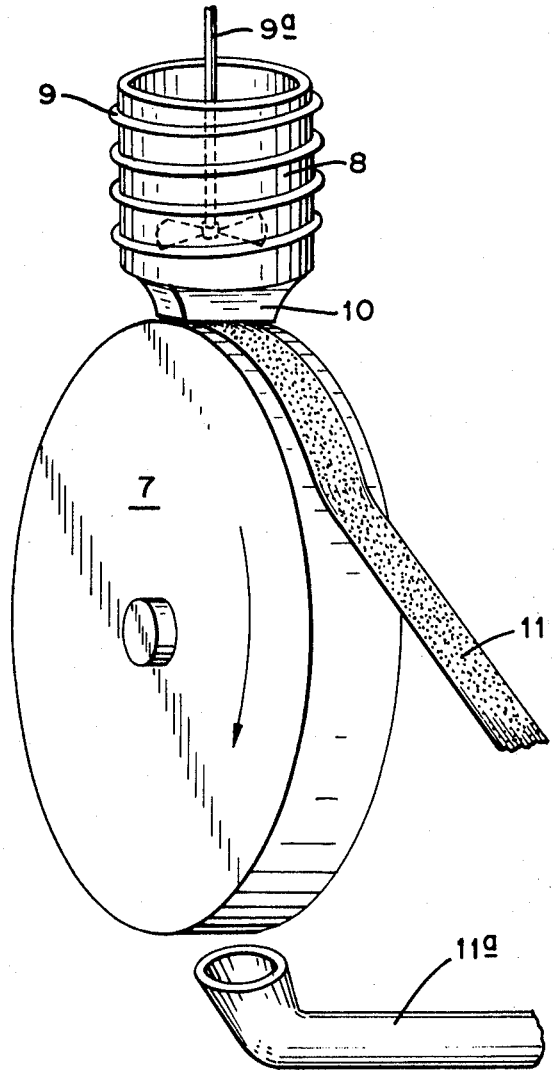
FIGS. 2 and 3 of the drawings each provide a somewhat simplified perspective view of two embodiments of apparatus suitable for the practice of the present invention in operation.

With reference to FIG. 2 of the drawings, which provides a perspective view of apparatus for carrying out the method of the present invention, there is shown an annular chill roll 7 rotatably mounted around its longitudinal axis, reservoir 8 for holding molten metal equipped with induction heating coils 9 and agitator 9*a*. When the density of the particulate matter is close to that of the melt, say between about 0.5 to about 2, preferably from about 0.8 to about 1.5 times that of the melt, simple induction stirring as that provided by the induction coils may be sufficient to maintain uniform dispersion of the particulate matter in the melt. Reservoir 8 is in communication with slotted nozzle 10, which, as above described, is mounted in close proximity to the surface of annular chill roll 7. Annular chill roll 7 may optionally be provided with cooling means (not shown), as means for circulating a cooling liquid, such as water, through its interior. Reservoir 8 is further equipped with means (not shown) for pressurizing the molten metal contained therein to effect expulsion thereof through nozzle 10. Agitator 9*a* agitates the molten metal to maintain uniformity of dispersion of the particulate matter in the molten metal. In operation, molten metal containing the dispersed particulate matter maintained under pressure in reservoir 8 is ejected through nozzle 10 onto the surface of the rotating chill roll 1, whereon it immediately solidifies to form strip 11. Due to unequal gaps between the first and second lips of the nozzle and the chill roll surface, as above discussed, strip 11 separates from the chill roll and is flung away therefrom to be collected by a suitable collection device (not shown). In FIG. 2 there is further shown nozzle 11*a* adapted to direct a stream of inert gas, such as helium, argon or nitrogen, against the surface of the chill roll ahead of slotted nozzle 10, for purposes described further below.

Figure 3:
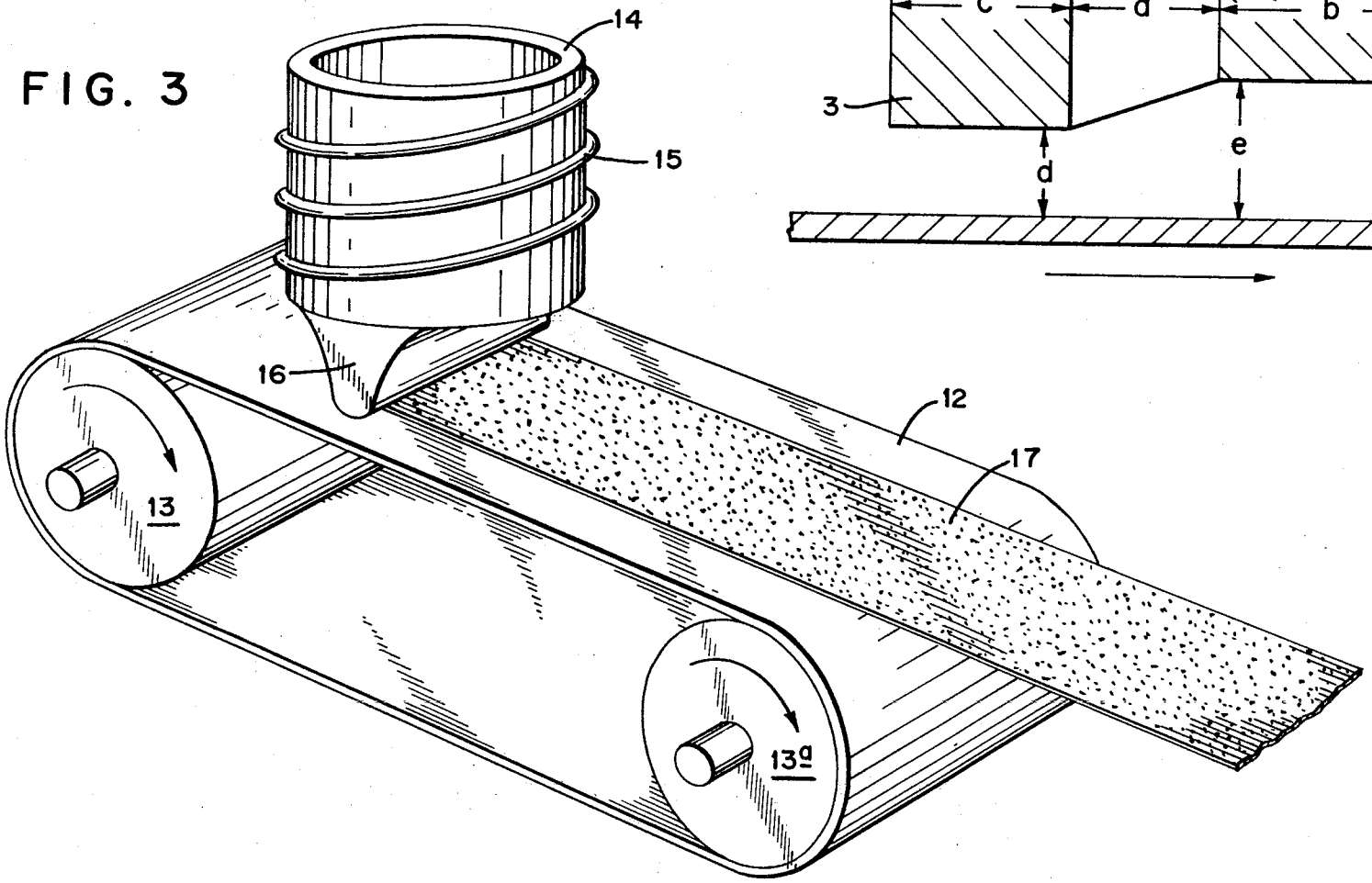

The embodiment illustrated by FIG. 3 of the drawings employs as chill body as endless belt 12 which is placed over rolls 13 and 13*a* which are caused to rotate by external means (not shown). Molten metal is provided from reservoir 14, equipped with means for pressurizing the molten metal therein and means for agitating the molten metal/particulate matter dispersion to maintain uniform dispersion of the particulate matter in the molten metal (neither means shown). Molten metal in reservoir 14 is heated by electrical induction heating coil 15. Reservoir 14 is in communication with nozzle 16 equipped with a slotted orifice. In operation, belt 10 is moved at a longitudinal velocity of at least about 600 meters per minute. Molten metal containing dispersed particulate matter from reservoir 14 is pressurized to force it through nozzle 16 into contact with belt 12, whereon it is solidified into a solid strip 17 containing embedded particulate matter, which is separated from belt 12 by means not shown.

The surface of the chill body which provides the actual chill surface can be any metal having relatively high thermal conductivity, such as copper. This requirement is particularly applicable if it is desired to make amorphous or mestastable strips. Preferred materials of construction include copper, especially oxygen-free copper, copper-beryllium, and mild steel, especially chromium plated mild steel.

In short run operation it will not ordinarily be necessary to provide cooling for the chill body, provided it has relatively large mass so that it can act as a heat sink and absorb considerable amount of heat. However, for longer runs, and especially if the chill body is a belt which has relatively little mass, cooling of the chill body is desirably provided. This may be conveniently accomplished by contacting it with cooling media which may be liquids or gases. If the chill body is a chill roll, water or other liquid cooling media may be circulated through it, or air or other gases may be blown over it. Alternatively, evaporative cooling may be employed, as by externally contacting the chill body with water or any other liquid medium which through evaporation provides cooling.

The slotted nozzle employed for depositing molten metal onto the chill surface may be constructed of any suitable material. Desirably, a material is chosen which is not wetted by the molten metal. A convenient material of construction is fused silica, which may be blown into desired shape and then be provided with a slotted orifice by machining.

The molten metal containing the dispersed particulate matter is heated, preferably in an inert atmosphere, to temperature approximately 50° to 100° C. above its melting point or higher. A slight vacuum may be applied to the vessel holding the dispersion to prevent premature flow through the nozzle. Ejection of the dispersion from the reservoir may be effected by the pressure of the static head, or preferably by pressurizing the reservoir to pressure in the order of, say, 0.5 to 1 psig, or until the dispersion is ejected. If pressures are excessive, the dispersion will be ejected at a rate higher than that at which it can be carried away by the chill surface, resulting in uncontrolled pressure flow. In a severe case, splattering may result. In a less severe case, strip having a ragged, irregular edge and of irregular thickness will be formed. Also, the width of the strip would be greater than the width of the slot. Correctness of pressure can be judged by the appearance of the strip; if it is uniformly dimensioned, correct pressure is applied. Correct pressure can thus be readily determined by simple, routine experimentation for each particular set of circumstances.

Exemplary metals which can be formed into polycrystalline strip containing embedded particulate matter include aluminum, tin, copper, iron, steel, stainless steel and the like.

Metal alloys which, upon rapid cooling from the melt, form solid amorphous structures are preferred. These are well known to those skilled in the art. Exemplary such alloys are disclosed in U.S. Pat. Nos. 3,427,154 and 3,981,722, as well as others.

In casting the strip product of the present invention, an inert atmosphere may be readily provided by the simple expedient of directing a stream of inert gas such as nitrogen, argon or helium against the moving chill surface ahead of the nozzle, as illustrated in FIG. 2. By this simple expedient, it is possible to cast reactive alloys such as $Fe_{70}Mo_{10}C_{18}B_2$ which burn readily when exposed to air in molten form.

The process of the present invention may be carried out in air, in a partial or high vacuum, or in any desired atmosphere which may be provided by an inert gas such as nitrogen, argon, helium, and the like. When it is conducted in vacuum, it is desirably conducted under vacuum within the range of from about 100 up to about 3000 microns.

As previously stated, the particulate matter to be incorporated into the metal strip must be compatible with the melt, that is to say substantially non-reactive with respect to the metal under processing conditions. It may be wetting or nonwetting with respect to the molten metal, wetting material being preferred. It must, of course, have a melting point above the temperature to which the metal is subjected in the process. Suitable particulate matter includes metal in powder or grit form, especially precipitated finely divided form, such as molybdenum, chromium, iron, tungsten, and the like; metal oxides; metal carbides, nitrides and borides; as well as high melting glasses. Exemplary particulate matter includes corundum, emery, garnet, quartz, quartzite, cristobalite, silica sand, basalt, granite, feldspar, mica schist, quartz conglomerate, boron carbide, diamond, cerium oxide, chromium oxide, clay (hard burned) boron nitride; fused alumina, iron oxides, periclase, silicon carbide, tantalum carbide, tin oxide, titanium carbide, molybdenum boride, chromium boride, complex carbides, synthetic aluminum oxide abrasive (e.g., Alundum, T.M.), tungsten carbide, zirconium oxide, zirconium silicate, and the like.

Preferred embodiments of particulate matter include molybdenum boride, chromium boride, alundum, corundum, and metal carbides such as boron carbide, silicon carbide, especially complex carbides.

In an especially desirable embodiment, the particulate matter is incorporated into the melt by precipitation of a finely dispersed solid phase from the melt upon cooling.

As previously stated, there is no lower limit on the particle size of the particulate matter. The upper limit is dictated by the dimensions of the nozzle and the gap between the lips and the chill surface. Preferred particulate matter has a particle size between about 1 micron and 100 micron, more preferably between about 20 micron and 80 micron and more preferably yet, between about 30 micron and 50 micron.

The maximum amount of particulate matter that may be incorporated into the metal strip by firmly embedding it in the metal matrix is determined by the requirement that the dispersion of the particulate matter in the molten metal must have sufficient fluidity to permit casting into strip by the present method. Usually, this requirement is met if the amount of particulate matter does not exceed about 30 percent by volume of the combined volume of the metal and the particulate matter. Desirably, the particulate matter does not exceed about 40 percent by weight of the combined weight of the particulate matter and the metal. In preferred embodiments, the particulate matter is employed in amount of up to about 10 percent by weight, more preferably yet in amount not exceeding about 5 percent by weight. In general, the amount employed will be governed by the intended use of the strip product. In the strip product, the particles are visible only on one side, the top side of the strip. Therefore, a surface enrichment is involved, and not a volume enrichment, so that even addition of a relatively small amount of particulate matter results in relatively dense packing of the particles on or near the surface.

The strip product of the present invention has particularly outstanding utility as an abrasive grinding tape, especially for use in numerically controlled grinding machines, because of its high dimensional stability and its durability, the particulate matter (abrasive) being firmly embedded in the metal matrix, the relatively high termal conductivity of the metal matrix providing improved heat dissipation.

The following example illustrates the present invention and sets forth the best mode presently contemplated for its practice.

EXAMPLE

Apparatus employed is similar to that depicted in FIG. 2. The chill roll employed has a diameter of 16 inches, and it is 4 inches wide. It is rotated at a speed of about 717 rpm, corresponding to a linear velocity of the peripheral surface of the chill roll of about 915 meters per minute. A nozzle having a slotted orifice of 0.9 millimeter width and 18 millimeter length, defined by a first lip of 0.9 millimeters width and a second lip of 1.3 millimeters width (lips numbered in direction of rotation of the chill roll) is mounted perpendicular to the direction of movement of the peripheral surface of the chill roll, such that the gap between the second lip and the surface of the chill roll is 0.45 millimeter, and the gap between the first lip and the surface of the chill roll is 0.4 millimeter. Metal having composition $Fe_{40}Ni_{40}B_{20}$ (atomic percent) with a melting point of about 1110° C. is employed. In the molten metal there is dispersed $MoB_2$ of fine particle size in amount of about 10 percent by weight. The molten metal is agitated by means of induction to maintain the $MoB_2$ particles in dispersion. The dispersion of the $MoB_2$ in the $Fe_{40}Ni_{40}B_{20}$ melt is obtained by separately adding the required amounts of molybdenum and boron to a melt of $Fe_{40}Ni_{40}B_{20}$ maintained at elevated temperature of about 1500° C. The molybdenum and boron react to form $MoB_2$, which at that temperature is completely dissolved in the melt. The melt is then permitted to cool gradually to temperature of about 1150° C., resulting in precipitation of finely divided $MoB_2$ from the melt. Particle size of the precipitated $MoB_2$ depends on the rate of cooling—lower cooling rates resulting in larger particles size. The molten metal containing the dispersed $MoB_2$ is held in a crucible wherein it is maintained under pressure of about $-\frac{1}{2}$ psig at temperature of 1150° C., for about 4 to 5 minutes. Pressure is then applied by means of an argon blanket at about 0.7 psig. The molten metal is expelled through the slotted orifice at the rate of about 8.35 kilograms per minute. It solidifies on the surface of the chill roll into a strip of about 2.5 mil (1/1000 in.) thickness having width of 1.8 centimeters. Upon examination using X-ray diffractometry, the metal compcnent of the strip is found to be amorphous in structure. The $MoB_2$ particles are evenly dispersed in random manner on the top surface of the strip, the individual particles being firmly embedded in the metal matrix. They cannot be mechanically dislodged. Efforts to pry them loose by means of a knife result in breakage of the particles, rather than dislodgement. The strip can be used as an abrasive tool.

When other metals are employed as base metal, and when other particulate matter is incorporated into a metal matrix in accordance with the method of the present invention, similar results are obtained, that is to say, metal strip containing firmly embedded particulate matter protruding from the top surface of the strip only is produced.

Since various changes and modifications may be made in the invention without departing from the spirit and essential characteristics thereof, it is intended that all matter contained in the above description be interpreted as illustrative only, the invention being limited by only the scope of the appended claims.

I claim:

1. A strip of amorphous metal containing embedded particulate matter which protrudes from the top surface of the strip.

2. A strip according to claim 1 wherein the particle size of the particulate matter is between about 1 and 100 microns.

3. A strip according to claim 2 containing particulate matter in amount of up to about 10 percent by weight of the combined weight of the particulate matter and the metal.

4. A strip according to claim 3 wherein the particulate matter is selected from the group consisting of molybdenum boride, chromium boride, synthetic aluminum oxide abrasive, corundum, boron carbide and silicon carbide.

5. A strip according to claim 3 wherein the particulate matter is molybdenum boride.

* * * * *